US007600896B2

(12) United States Patent
Wang

(10) Patent No.: US 7,600,896 B2
(45) Date of Patent: Oct. 13, 2009

(54) OUTER CASE OF LED MODULE

(76) Inventor: Baoliang Wang, 4801 Littlejohn St., Suite G, Bladwin Park, CA (US) 91706

( * ) Notice: Subject to any disclaimer, the term of this patent is extended or adjusted under 35 U.S.C. 154(b) by 30 days.

(21) Appl. No.: 11/881,462

(22) Filed: Jul. 27, 2007

(65) Prior Publication Data

US 2009/0027901 A1 Jan. 29, 2009

(51) Int. Cl.
*F21S 4/00* (2006.01)
*F21V 21/00* (2006.01)

(52) U.S. Cl. ..... 362/249.02; 362/240; 362/374; 362/800

(58) Field of Classification Search ..... 362/240, 362/249, 368, 374–375, 800, 249.01, 249.02
See application file for complete search history.

(56) References Cited

U.S. PATENT DOCUMENTS 6,837,598 B2 * 1/2005 Marcus ..... 362/374

2005/0231943 A1 * 10/2005 Sloan et al. ..... 362/219

* cited by examiner

*Primary Examiner*—Jason Moon Han
(74) *Attorney, Agent, or Firm*—Raymond Y. Chan; David and Raymond Patent Firm

(57) ABSTRACT

An outer case of a LED module includes a top case and a bottom case to receive the LED module therebetween. The top case has a plurality of through holes and a plurality of blocks spacedly protruding from an inner side of the top case. The bottom case has a plurality of corresponding clip holes spacedly formed thereat, wherein the blocks are detachably engaged with the clip holes respectively to detachably couple the top case with the bottom case so as to form a cavity therebetween for receiving the LED module at a position that portions of LEDs are protruded through the through holes respectively. Two wire holes are formed at two sides of the top case when the top case is coupled with the bottom case for guiding wires of the LED module extending out of the cavity through the wire holes respectively.

12 Claims, 9 Drawing Sheets

OUTER CASE OF LED MODULE

BACKGROUND OF THE PRESENT INVENTION

1. Field of Invention

The present invention relates to an outer case of an illuminator, and more particularly to an outer case of an Light Emitting Diode (LED) module comprising a top case and a bottom case matching the top case when closing, wherein the top case comprises a top board, two side boards and two end boards, and the bottom case comprises a bottom board, a first closing board and a second closing board.

2. Description of Related Arts

As everybody knows, with the developing of the optical electronics and the semiconductor illuminating technique, the LED illuminator has been used everywhere, because of its good working property. First of all, an LED uses low voltage power supply, which is safer than high voltage power supply. Secondly, an LED is small in size, so that it can be prepared with any shape to meet the requirement of the environment. Thirdly, it has long life-span, and low light attenuation. Moreover, the response time of LED is short.

Because of above the properties of LED, people love applying it into the production of many consumer products.

The traditional LED illuminator has a fatal drawback of low intensity, so that it can not be widely used in a very long time.

Then, LEDs are connected in series to enhance its intensity. More specifically, connecting LEDs in series, and depositing them in a case can enhance the LED illuminating intensity. At present, in a typical application, three LEDs are connected in series or in parallel to form a module so as to serve as illuminating source or background light. The module can be usually divided into two types, one is waterproof, and the other is non-waterproof. However the structural design of the non-waterproof outer case of an LED module is simple in idea, so that its safety performance and the appearance is not the best. Furthermore, the mounting and assembling process of the outer case is not convenient.

SUMMARY OF THE PRESENT INVENTION

A main object of the present invention is to provide an outer case of LED module, which is simple in structure and good in appearance.

Another object of the present invention is to provide an outer case of LED module, which has simple mounting and assembling process, and can be used safely.

Accordingly, in order to accomplish the above object, the present invention provides an outer case of a LED module according to a preferred embodiment of the present invention is illustrated, in which the outer case works with a LED module, wherein the LED module comprises a base board, a plurality of LED illuminator and wire, wherein the LED illuminators are spacedly aligned on the base board and connected in series by wires through base board.

The outer case of the LED module comprises a top case and a bottom case, wherein the top case comprises a top board, two side boards and two end boards. The top board has a top surface, a bottom surface, and a plurality of through holes, wherein the through holes are provided between the top surface and the bottom surface. The two side board is on the both side of the top board, comprising a first connecting board and the second connecting board, wherein the first connecting board is connected to one side of the top board, having a outer side surface and a inner side surface, and having a plurality of blocks protruding from the inner side surface, wherein each block comprises a clip hook provided on the top the blocks. The second connecting board is connected to the other side of the top board facing to the first connecting board, having a outer side surface and a inner side surface, and having a plurality of blocks protruding from the inner side surface, wherein each block comprises a clip hook provided on the top the blocks. The two end board is provided on the both end of the top board, and connected with the both end of the two side board respectively, comprising a first end board and a second end board, wherein the first end board are connected with the top board on the top, and connected with one end of the two side board, wherein the first end board has an outer surface, an inner surface, and a plurality of wire holes. The second end board is connected with top board on the top, and connected with the other end of the two side board, wherein the second end board has an outer surface, an inner surface, and a plurality of wire holes.

At last, the bottom surface of the top board, the inner surface of the first connecting board, the inner surface of the second connecting board, the inner surface of the first end board, and the inner surface of the second end board define an opening cavity.

The bottom case matches the top case when closing, comprising a bottom board, a first closing board, and a second closing board, wherein the bottom board has a top surface and a bottom surface, and the first closing board is connected with one side of the bottom board at the bottom, comprising an outer closing board surface, an inner closing board surface, and a plurality of clip holes, wherein the clip holes is corresponding to the blocks of the first connecting board of the top case. The second closing board is connected with the other side of the bottom board at the bottom, comprising an outer closing board surface, an inner closing board surface, and a plurality of clip holes, wherein the clip holes is corresponding to the blocks of the second connecting board of the top case. At last, the top surface of the bottom board of the bottom case closes the opening cavity to a receiving cavity.

The benefit of the present invention is illustrated below: the present invention comprises a top case and a bottom case, wherein the top case comprises a top board, two side boards and two end boards.

These and other objectives, features, and advantages of the present invention will become apparent from the following detailed description, the accompanying drawings, and the appended claims. The bottom case matches the top case when closing, comprising a bottom board, a first closing board, and a second closing board. Such a structure design can provide a LED module outer case that is simple in structure, good in appearance, has simple mounting and assembling process, and can be used safely.

DETAILED DESCRIPTION OF THE PREFERRED EMBODIMENT

Figure 1:
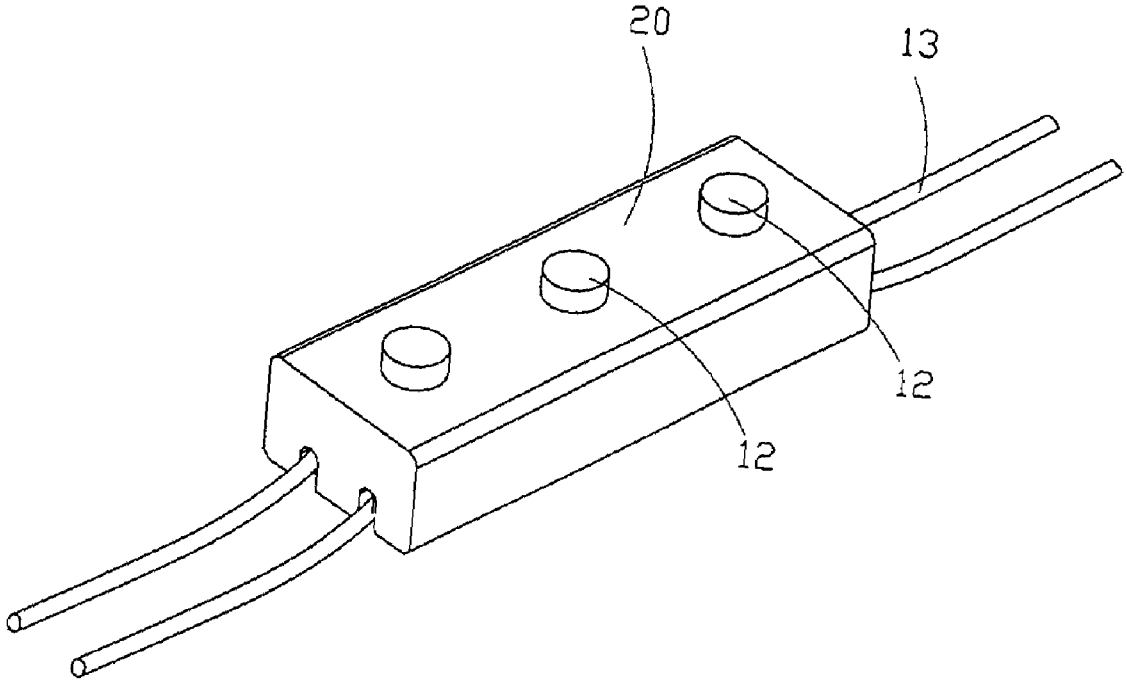
FIG. 1 is a perspective view of an outer case of a LED module in a composition manner according to a preferred embodiment of the present invention.
Figure 2:
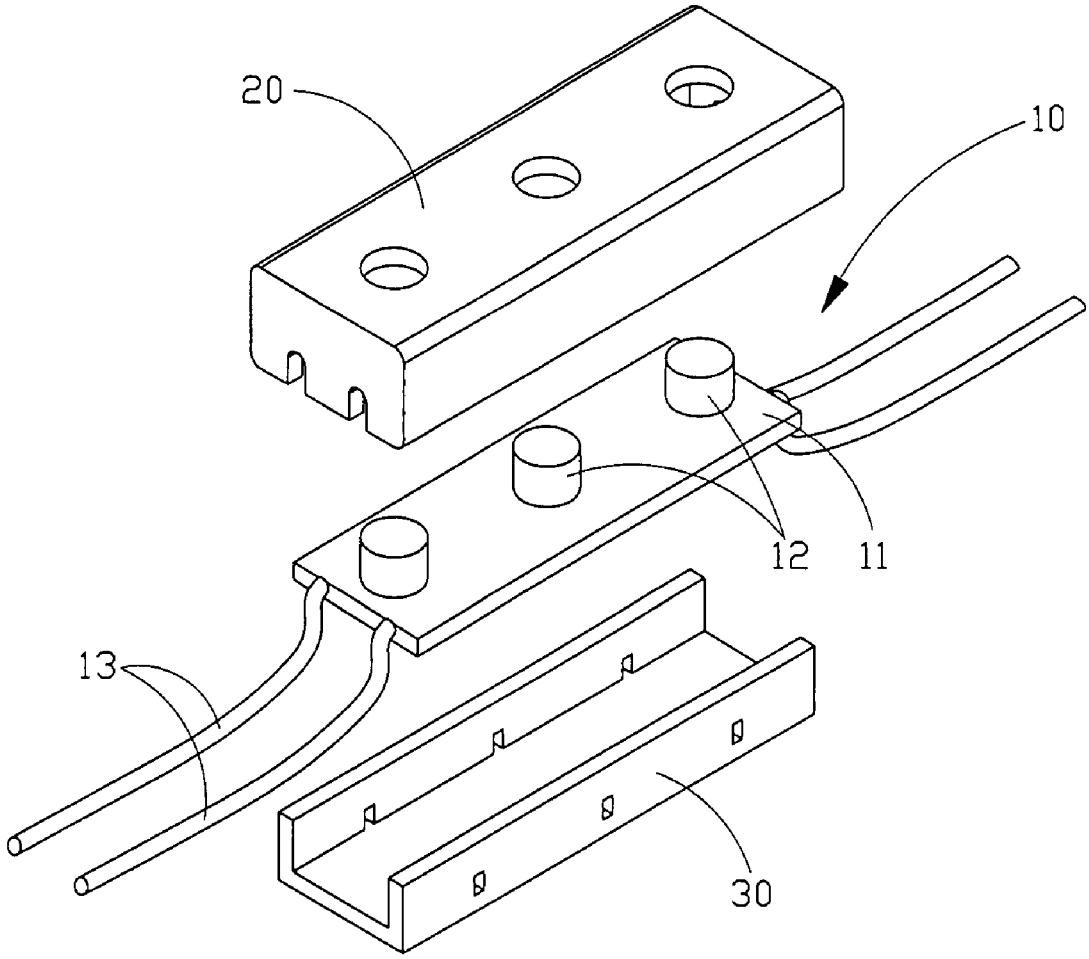
FIG. 2 is a perspective view of an outer case of a LED module in a decomposition manner according to the above preferred embodiment of the present invention.
Figure 3:
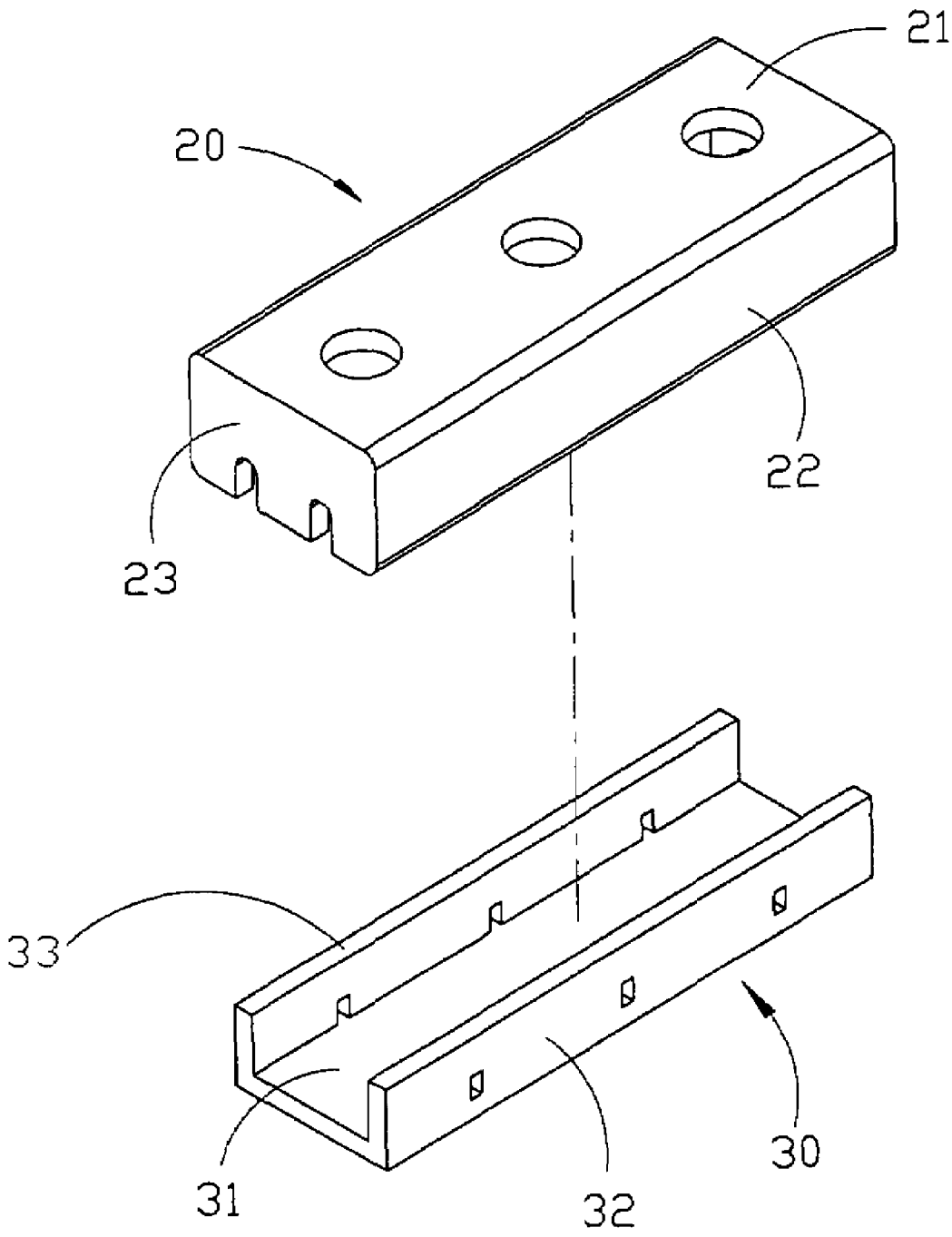
FIG. 3 is an exploded perspective view of an outer case of a LED module according to the above preferred embodiment of the present invention.
Figure 4:
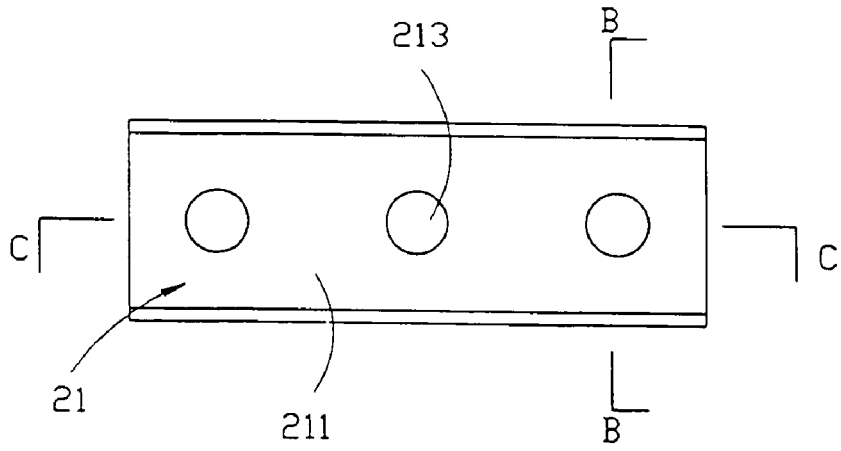
FIG. 4 is a top exterior view of a top case of the outer case of a LED module according to the above preferred embodiment of the present invention.
Figure 5:
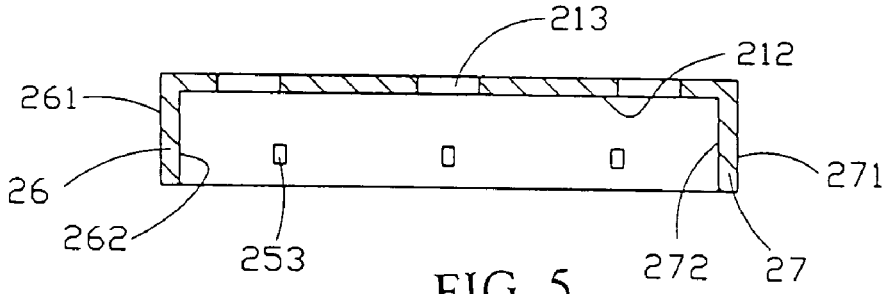
FIG. 5 is a C-C sectional view of FIG. 4.
Figure 6:
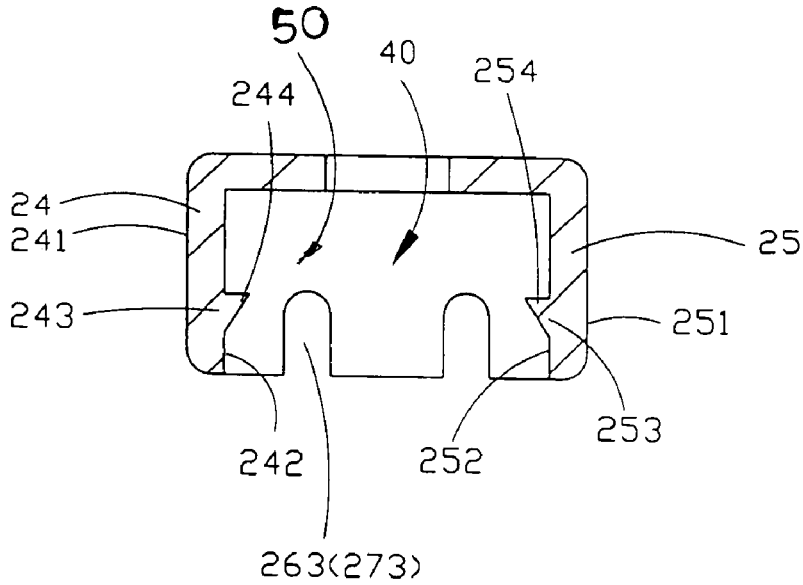
FIG. 6 is a D-D sectional view of FIG. 4.
Figure 7:
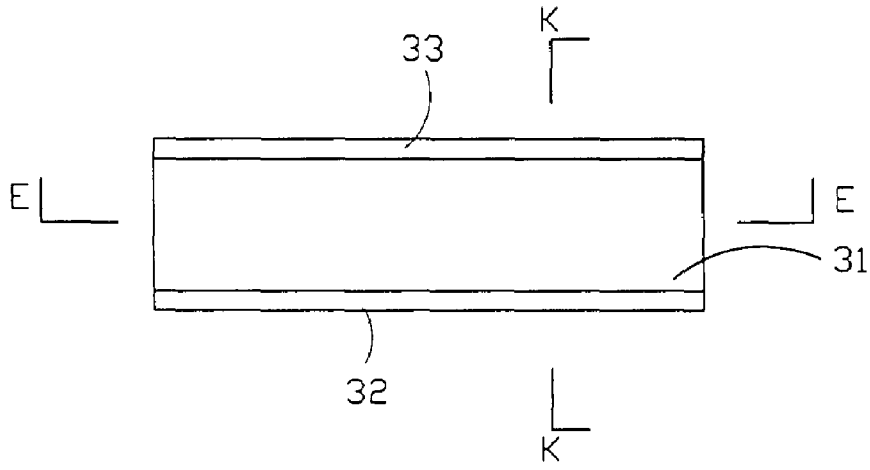
FIG. 7 is a top exterior view of a bottom case of the outer case of a LED module according to the above preferred embodiment of the present invention.
Figure 8:
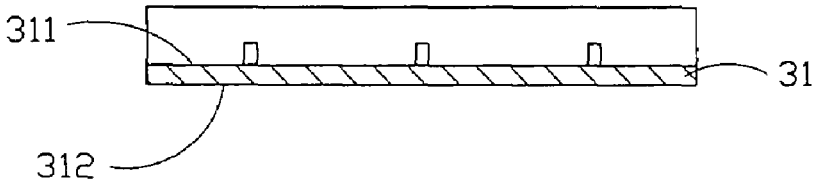
FIG. 8 is an E-E sectional view of FIG. 7.
Figure 9:
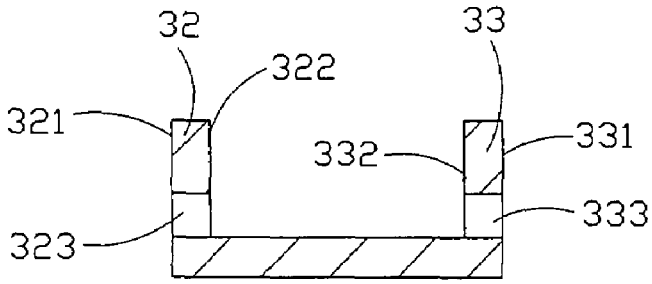
FIG. 9 is a K-K sectional view of FIG. 7.
Figure 10:
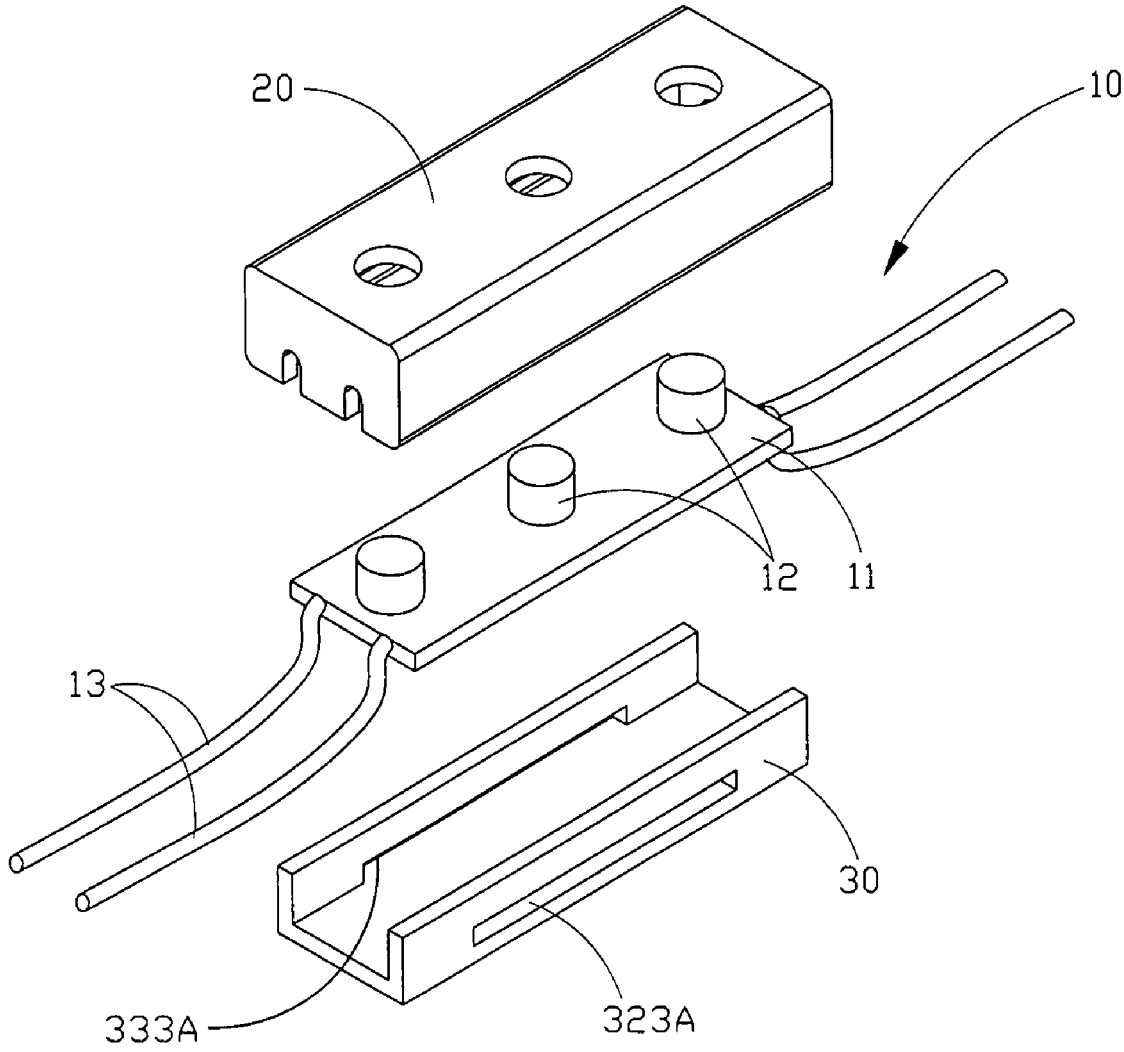
FIG. 10 is an alternative mode of exploded perspective view of an outer case of a LED module according to the above preferred embodiment of the present invention.
Figure 11:
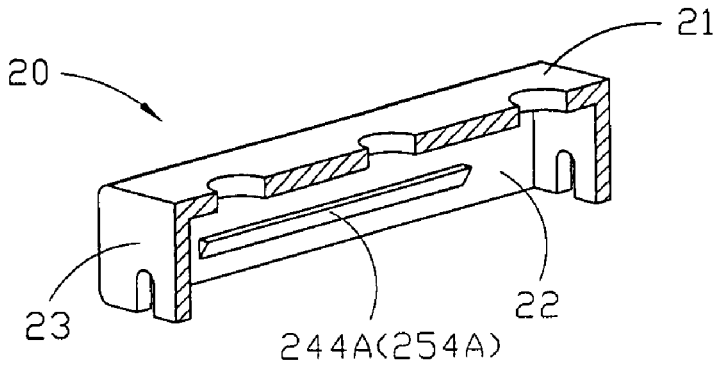
FIG. 11 is an alternative mode of a sectional view of an outer case of a LED module according to the above preferred embodiment of the present invention.
Figure 12:
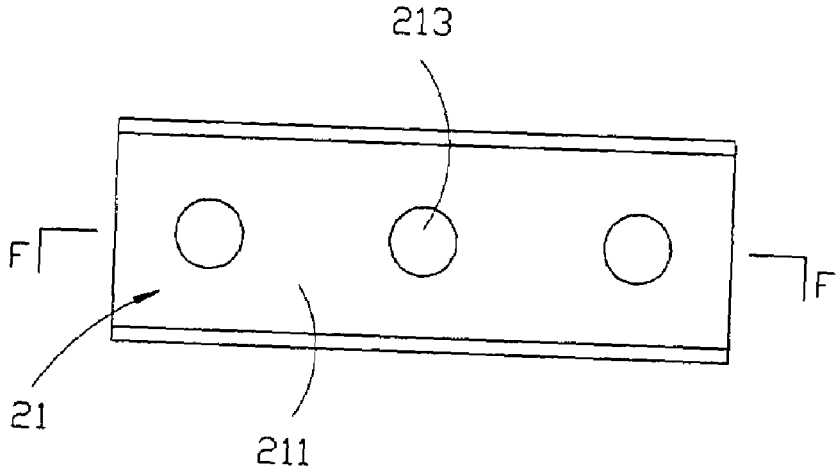
FIG. 12 is an alternative mode of a top exterior view of an outer case of a LED module according to the above preferred embodiment of the present invention.
Figure 13:
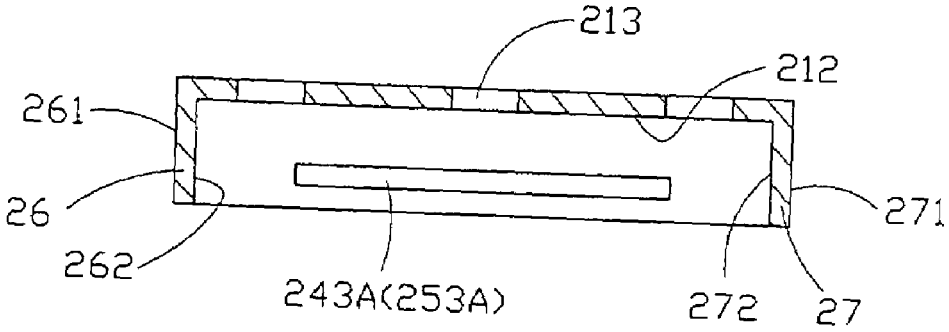
FIG. 13 is an F-F sectional view of FIG. 12.

Referring to FIG. 1 to FIG. 9 of the drawings, an outer case of an LED (Light Emitting Diode) module according to a preferred embodiment of the present invention is illustrated, in which the outer case works with an LED module, wherein the LED module 10 comprises a base board 11, a plurality of LED illuminator 12 and wire 13, wherein the LED illuminators 12 are spacedly aligned on the base board 11 and connected in series by wires 13 through base board 11.

The outer case of the LED module comprises a top case 20 and a bottom case 30, wherein the top case 20 comprises a top board 21, two side boards 22 and two end boards 23.

The top board 21 has a top surface 211, a bottom surface 212, and a plurality of through holes 213, wherein the through holes are provided between the top surface 211 and the bottom surface 212.

The two side board 22 is on the both side of the top board 21, comprising a first connecting board 24 and the second connecting board 25, wherein the first connecting board is connected to one side of the top board 21, having an outer side surface 241 and an inner side surface 242, and having a plurality of blocks 243 protruding from the inner side surface 242, wherein each block 243 comprises a clip hook 244 provided on the top the blocks 243.

The second connecting board 25 is connected to the other side of the top board 21 facing to the first connecting board 24, having an outer side surface 251 and an inner side surface 252, and having a plurality of blocks 253 protruding from the inner side surface 252, wherein each block 253 comprises a clip hook 254 provided on the top the blocks 253. The clip hook 254 is integrally protruded from an inner side of the respective side board 24, 25.

The two end board 23 is provided on the both end of the top board 21, and connected with the both end of the two side board 22 respectively, comprising a first end board 26 and a second end board 27, wherein the first end board 26 are connected with the top board 21 on the top, and connected with one end of the two side board 22, wherein the first end board 26 has an outer surface 261, an inner surface 262, and a plurality of wire holes 263.

The second end board 27 is connected with top board 21 on the top, and connected with the other end of the two side board 22, wherein the second end board 27 has an outer surface 271, an inner surface 272, and a plurality of wire holes 273.

At last, the bottom surface 212 of the top board 21, the inner surface 242 of the first connecting board 24, the inner surface 252 of the second connecting board 25, the inner surface 262 of the first end board 26, and the inner surface 272 of the second end board 27 define an opening cavity 40.

The bottom case 30 matches the top case 20 when closing, comprising a bottom board 31, a first closing board 32, and a second closing board 33, wherein the bottom board 31 has a top surface 311 and a bottom surface 312, and the first closing board 32 is connected with one side of the bottom board 31 at the bottom, comprising an outer closing board surface 321, an inner closing board surface 322, and a plurality of clip holes 323, wherein the clip holes 323 is corresponding to the blocks 243 of the first connecting board 24 of the top case 20.

The second closing board 33 is connected with the other side of the bottom board 31 at the bottom, comprising an outer closing board surface 331, an inner closing board surface 332, and a plurality of clip holes 333, wherein the clip holes 333 is corresponding to the blocks 253 of the second connecting board 25 of the top case 20.

At last, the top surface 311 of the bottom board 31 of the bottom case 30 closes the opening cavity 40 to a receiving cavity 50. Accordingly, each of the clip holes 323, 333 is a through hole formed on the respective closing board 32, 33, wherein the side boards 24, 25 are overlapped on outer sides of the closing boards 32, 33 to engage the blocks 243, 253 with the clip holes 323, 333 respectively.

When using the present invention, put the LED module 10 into the receiving cavity 50, and the LED illuminators 12 of the LED module 10 can stretch out from the receiving cavity 50 to the outside through the through holes 213 on the top case 20. At the same time, the wires 13 of the LED module 10 stretch out from the receiving cavity to the outside through the wire holes 263 and 273. And then close the top case 20 and the bottom case 30 together. More specifically, the blocks 245 and 253 of the top base 20 clip to the clip hole 323 and 333 respectively so as to retain the LED module 10 in the receiving cavity defined by the top case 20 and the bottom case 30.

As shown in FIG. 1 to FIG. 13, an alternative mode of the present invention is illustrated. The outer case of the LED module comprises a top case 20 and a bottom case 30, wherein the top case 20 comprises a top board 21, two side boards 22 and two end boards 23.

As shown in FIG. 10 to FIG. 13, the two side board 22 is on the both side of the top board 21, comprising a first connecting board 24 and the second connecting board 25, wherein the first connecting board is connected to one side of the top board 21, having an outer side surface 241 and an inner side surface 242, and having a block 243A protruding from the inner side surface 242, wherein the block 243A comprises a clip hook 244A provided on the top the block 243A. The clip hook 254A is integrally protruded from an inner side of the respective side board 24, 25.

The second connecting board 25 is connected to the other side of the top board 21 facing to the first connecting board 24, having an outer side surface 251 and an inner side surface 252, and having a block 253A protruding from the inner side surface 252, wherein each block 253A comprises a clip hook 254A provided on the top the block 253A.

The bottom case 30 matches the top case 20 when closing, comprising a bottom board 31, a first closing board 32, and a second closing board 33, wherein the bottom board 31 has a top surface 311 and a bottom surface 312, and the first closing board 32 is connected with one side of the bottom board 31 at the bottom, comprising an outer closing board surface 321, an inner closing board surface 322, and a clip hole 323A, wherein the clip hole 323A is corresponding to the block 243A of the first connecting board 24 of the top case 20.

The second closing board 33 is connected with the other side of the bottom board 31 at the bottom, comprising an outer closing board surface 331, an inner closing board surface 332, and a clip hole 333A, wherein the clip hole 333A is corresponding to the block 253A of the second connecting board 25 of the top case 20. Accordingly, each of the clip holes 323A, 333A is an elongated through slot formed on the respective closing board 32, 33, wherein the side boards 24, 25 are overlapped on outer sides of the closing boards 32, 33 to engage the blocks 243A, 253A with the clip holes 323A, 333A respectively. It is worth to mention that the base board 11 is received in the cavity at a position that portions of the LEDs 12 are protruded out of the top case 20 through the through holes 213 thereof respectively, wherein the wires 13 are extended out of the cavity through the wire holes 263, 273 respectively.

Figure 14:
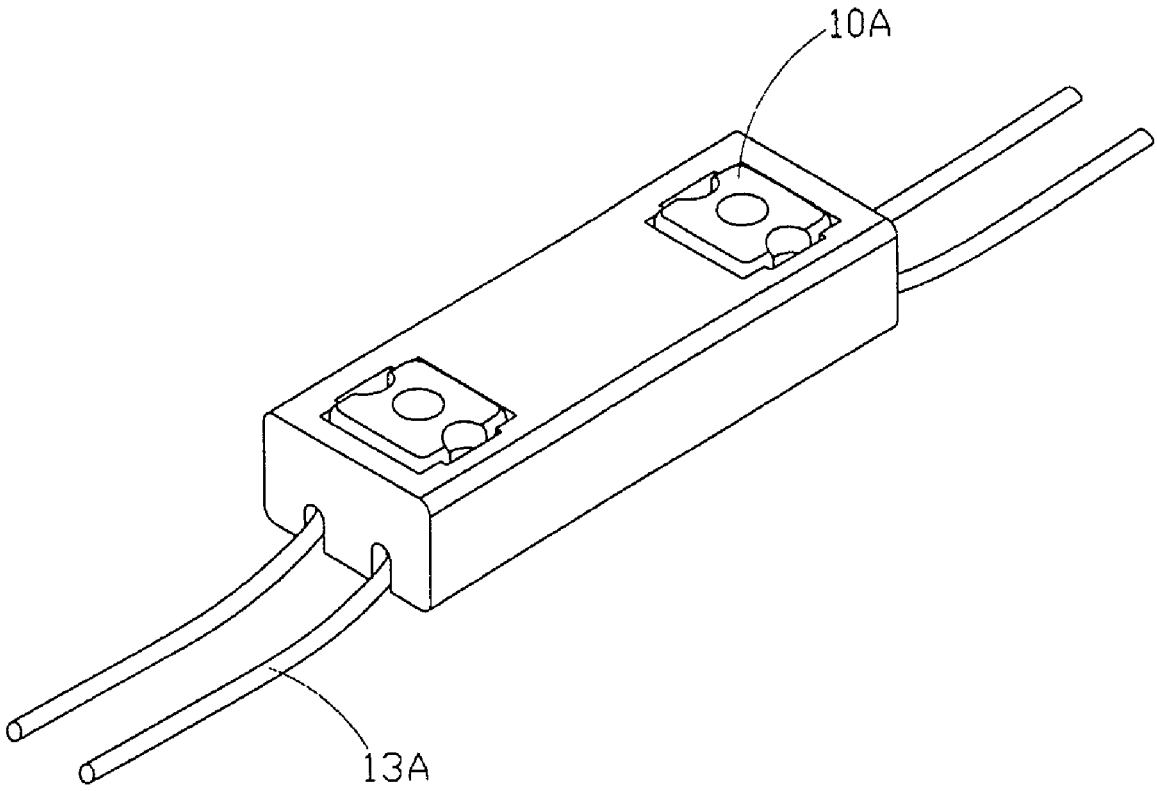
FIG. 14 is another alternative mode of perspective view of an outer case of a LED module according to the above preferred embodiment of the present invention.
Figure 15:
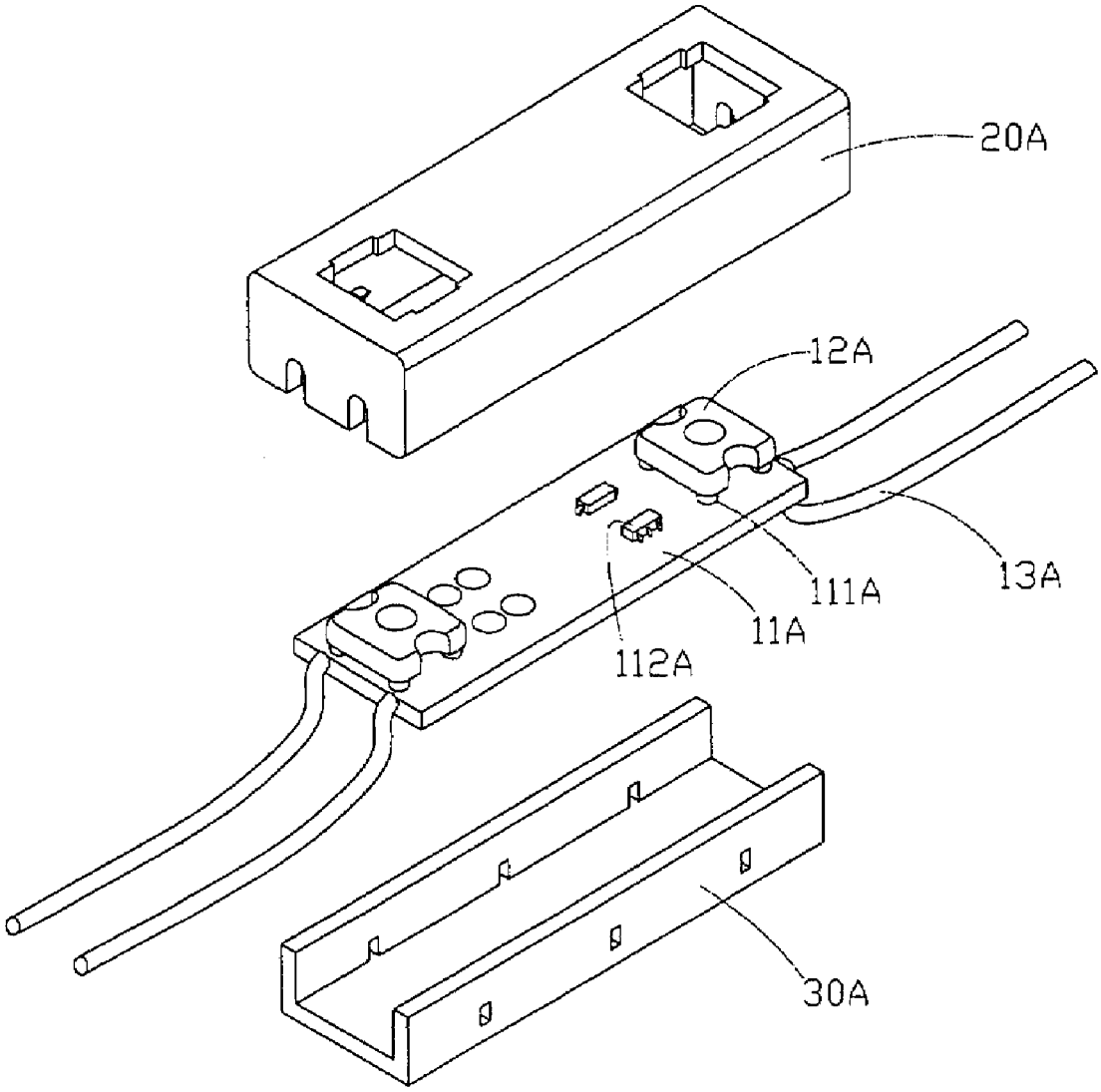
FIG. 15 is another alternative mode of exploded perspective view of an outer case of a LED module according to the above preferred embodiment of the present invention.

As shown in FIG. 14 to FIG. 15, another alternative mode of the present invention is illustrated. The outer case works with a LED module 10A, wherein the LED module 10A comprises a base board 11A, a plurality of LED illuminator 12A and wire 13A.

The base board 11A is connected with the wire 13A, comprising a plurality of LED electrical connecting element 111A and a constant current chip 112A, wherein each LED electrical connecting element 111A comprises four electrical connectors.

The constant current chip 112A is connected with the LED electrical connecting elements 111A, so that the current in the LED electrical connecting elements 111A is in constant with the help of the structure of the constant current chip 112A, so as to keep the illuminating intensity of the LED illuminator 12A from attenuating.

Further more, the constant current chip 112A is connected with the wire 13A at the input end, and connected with the LED electrical connecting elements 111A at the output end.

The LED illuminator 12A is cannibal series, and each LED illuminator 12A comprises four electrical connectors. Any of the LED illuminator 12A is connected with the LED electrical connecting element 111A respectively. The LED module case comprises a top case 20A and a bottom case 30A.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An LED module device, comprising:

an LED module which comprises a base board, a plurality of LED illuminators and wires, wherein said LED illuminators are spacedly provided on said base board and electrically connected by wires through said base board; and an outer case, which comprises a top case and a bottom case, wherein said top case comprises a top board and two side boards, wherein said top board has a plurality of through holes spacedly formed therein and each of said side boards has at least a block protruded from an inner side thereof, and wherein said bottom case comprises a bottom board and two closing boards connected with two sides of the bottom board respectively, wherein each of said closing boards has at least a clip hole formed therein, wherein said side boards of said top case are respectively and overlappedly coupled with said closing boards of said bottom case and said blocks of said top case are detachably engaged with said clip holes respectively to form said outer case and to define a receiving cavity within said two closing boards and said bottom board of said bottom case and said top board of said top case, wherein said LED module is received in said receiving cavity at a position that top portions of said LED illuminators are extended out of said top case through said through holes thereof respectively while said wires of said LED module are extended out of said receiving cavity at two ends of said top case respectively, wherein each of said clip holes is a through hole formed on said respective closing board and said side boards are overlapped on outer sides of said closing boards to engage said blocks with said clip holes respectively.

2. The LED module device, as recited in claim 1, wherein each of said blocks comprises a clip hook provided on a top thereof, wherein said clip hooks are integrally protruded from said inner sides of said side boards respectively.

3. The LED module device, as recited in claim 2, wherein said top case comprises two end boards each extending between two ends of said two side boards, wherein wire holes are provided in each of said end boards and said wires of said LED module are extended out of said receiving cavity through said wire holes respectively after said top case is coupled with said bottom case.

4. The LED module device, as recited in claim 2, wherein said top case comprises two end boards each extending between two ends of said two side boards, wherein wire holes are provided in each of said end boards and said wires of said LED module are extended out of said receiving cavity through said wire holes respectively after said top case is coupled with said bottom case.

5. The LED module device, as recited in claim 1, wherein each of said clip holes is an elongated through slot formed on said respective closing board to engage with said respective block.

6. The LED module device, as recited in claim 2, wherein each of said clip holes is an elongated through slot formed on said respective closing board to engage with said respective block.

7. The LED module device, as recited in claim 3, wherein each of said clip holes is an elongated through slot formed on said respective closing board to engage with said respective block.

8. The LED module device, as recited in claim 4, wherein each of said clip holes is an elongated through slot formed on said respective closing board to engage with said respective block.

9. The LED module device, as recited in claim 5, wherein said base board further comprises a plurality of LED electrical connecting elements connecting said LED illuminators to said base board and a constant current chip electrically connecting with said LED electrical connecting elements for keeping a current in said LED electrical connecting elements in constant.

10. The LED module device, as recited in claim 6, wherein said base board further comprises a plurality of LED electrical connecting elements connecting said LED illuminators to said base board and a constant current chip electrically connecting with said LED electrical connecting elements for keeping a current in said LED electrical connecting elements in constant.

11. The LED module device, as recited in claim 7, wherein said base board further comprises a plurality of LED electrical connecting elements connecting said LED illuminators to said base board and a constant current chip electrically connecting with said LED electrical connecting elements for keeping a current in said LED electrical connecting elements in constant.

12. The LED module device, as recited in claim 8, wherein said base board further comprises a plurality of LED electrical connecting elements connecting said LED illuminators to said base board and a constant current chip electrically connecting with said LED electrical connecting elements for keeping a current in said LED electrical connecting elements in constant.

* * * * *